US010371361B2

(12) United States Patent
Chien

(10) Patent No.: US 10,371,361 B2
(45) Date of Patent: Aug. 6, 2019

(54) DEVICE HAS LED TRACK MEANS WITH REMOVABLE LED-UNITS WHICH CLIP-ON ANYWHERE ALONG THE LENGTH OR ADD-ON FROM ENDS

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 107 days.

(21) Appl. No.: 15/458,498

(22) Filed: Mar. 14, 2017

(65) Prior Publication Data

US 2017/0184283 A1 Jun. 29, 2017

Related U.S. Application Data

(63) Continuation-in-part of application No. 13/367,687, filed on Feb. 7, 2012, now Pat. No. 9,625,134, which
(Continued)

(51) Int. Cl.
*F21S 8/00* (2006.01)
*F21K 9/275* (2016.01)
(Continued)

(52) U.S. Cl.
CPC ..... *F21V 21/005* (2013.01); *F21K 9/275* (2016.08); *F21S 8/038* (2013.01); *F21V 15/01* (2013.01);
(Continued)

(58) Field of Classification Search
CPC ..... F21K 9/00; F21K 9/235; F21S 2/005; F21S 4/20; F21S 4/28; F21S 8/026; F21S 8/03;
(Continued)

(56) References Cited

U.S. PATENT DOCUMENTS 4,471,415 A * 9/1984 Larson ..... F21V 21/34 362/249.14
4,999,755 A * 3/1991 Lin ..... F21S 2/00 362/217.02
(Continued)

*Primary Examiner* — William N Harris
(74) *Attorney, Agent, or Firm* — Bacon & Thomas, PLLC

(57) ABSTRACT

The LED light has Track to install LED-units anywhere along the length. The LED-unit has pair of resilient or pop-out & fall-down movable contactor so can fit-within or add-on LED-units to track and connect with metal bus-strip(s) which has electric current or-and magnetic force to adhesive the pop-out & fall-down contactor on back of the LED-unit. LED light device including LED light source, or mini size LED fluorescent tube, or mini LED light bar, or mini LED Bulb, or mini LED lamp, mini LED Lamp as light source has housing to fit-in or add-on or magnetic adhesive on track to form a finish light device and get power from built-in or outside AC-to-DC transformer, circuit, power source and can control by switch, remote controller, motion/moving detector(s) sensor, all kind of sensor, APP software while incorporate with Wifi or wireless network to make the on-off, color changing, color mix, dimmer adjustment, moving light, all other light show for LED track light has fit-in LED-units by resilient contractors or LED track light has add-on LED-units by pop-out & fall-down movable contactor built on back of LED-unit and adhesive by magnetic force bus-strips.

22 Claims, 9 Drawing Sheets

Figures 1, 2, 3, 4, 5, 6, 7, 8, 9, 10, 11, 12, 13, 14, 15, 16, 17, 18, 19:
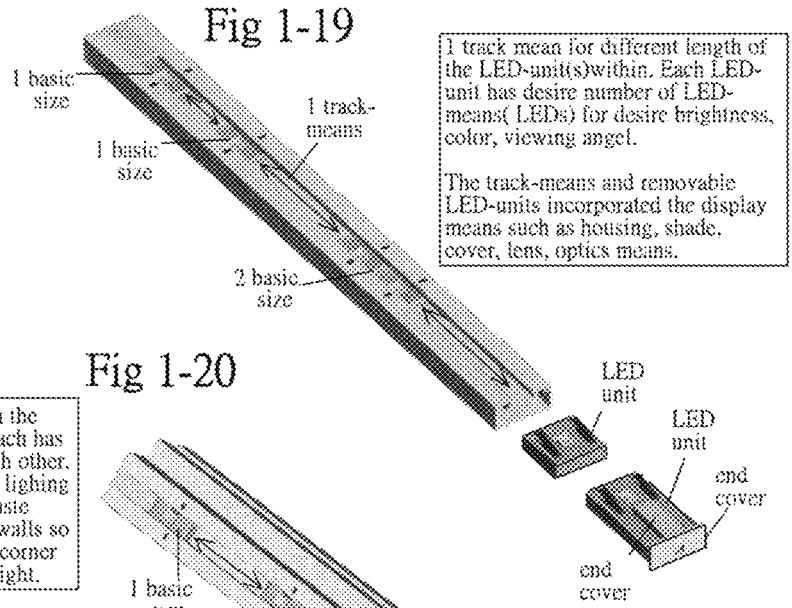
Figures 1, 2, 3, 4, 5, 6, 7, 8, 9, 10, 11, 12, 13, 14, 15, 16, 17, 18, 19, 20:
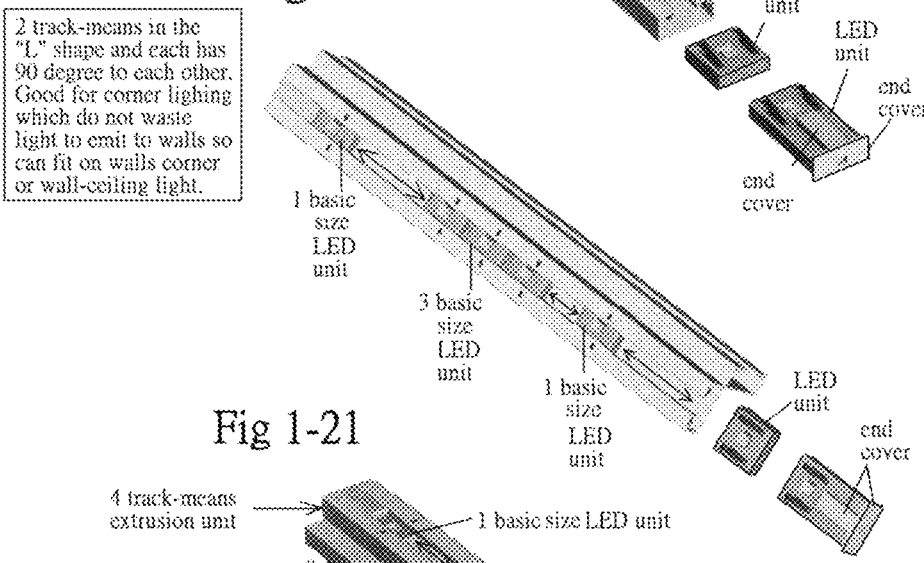
Figures 1, 2, 3, 4, 5, 6, 7, 8, 9, 10, 11, 12, 13, 14, 15, 16, 17, 18, 19, 20, 21:
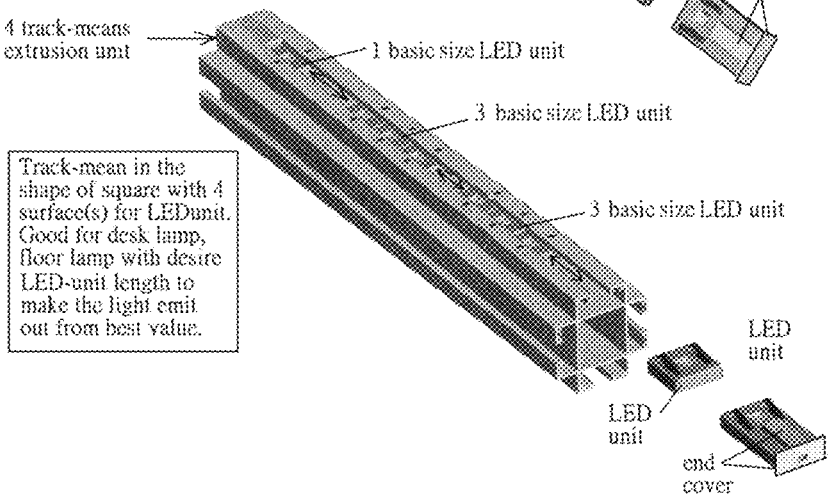
Figure 4:
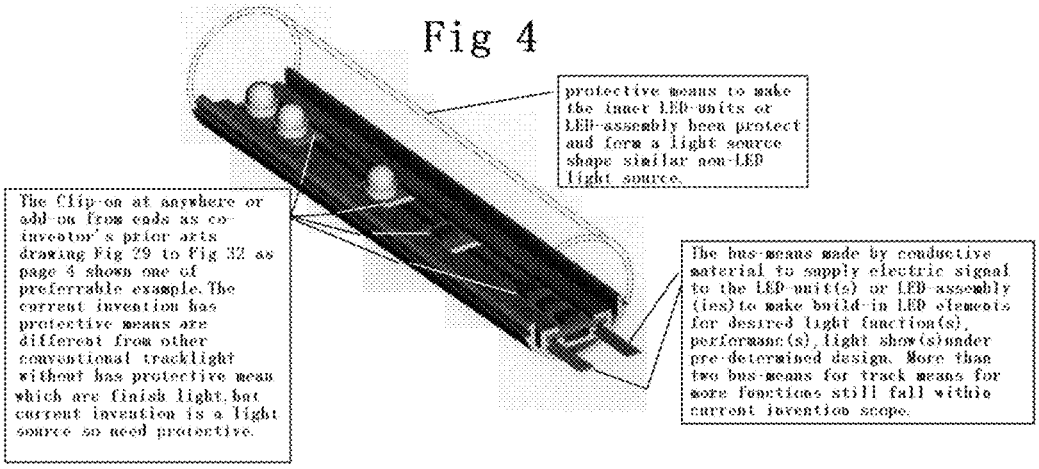
Figure 6:
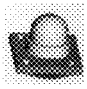
Figure 7:
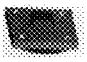
Figure 8:
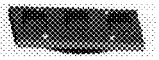
Figure 8:
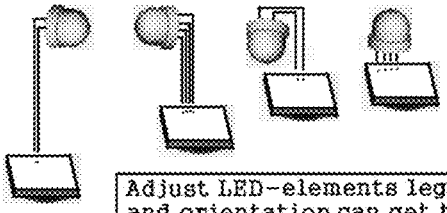

Related U.S. Application Data is a continuation-in-part of application No. 13/367,816, filed on Feb. 7, 2012, now Pat. No. 8,944,669, and a continuation-in-part of application No. 13/162,824, filed on Jun. 17, 2011, now Pat. No. 8,950,899, and a continuation-in-part of application No. 12/894,865, filed on Sep. 30, 2010, now Pat. No. 8,393,755.

(51) Int. Cl.

| | |
|---|---|
| ***F21V 15/01*** | (2006.01) |
| ***F21V 17/10*** | (2006.01) |
| ***F21V 17/16*** | (2006.01) |
| ***F21V 21/08*** | (2006.01) |
| ***F21V 23/06*** | (2006.01) |
| ***F21V 21/005*** | (2006.01) |
| ***F21V 21/088*** | (2006.01) |
| ***F21V 21/096*** | (2006.01) |
| ***F21Y 103/10*** | (2016.01) |
| ***F21Y 115/10*** | (2016.01) |

(52) U.S. Cl.

CPC ..... *F21V 17/104* (2013.01); *F21V 17/105* (2013.01); *F21V 17/16* (2013.01); *F21V 21/08* (2013.01); *F21V 21/088* (2013.01); *F21V 21/096* (2013.01); *F21V 23/06* (2013.01); *F21Y 2103/10* (2016.08); *F21Y 2115/10* (2016.08)

(58) Field of Classification Search

CPC .. F21S 8/038; F21S 2/00; F21V 7/005; F21V 15/013; F21V 17/105; F21V 19/006; F21V 21/005; F21V 21/08; F21V 21/35; F21V 23/005; F21V 23/06; F21V 21/088; F21V 21/096; H01R 25/14

See application file for complete search history.

(56) References Cited

U.S. PATENT DOCUMENTS

| | | | | |
|---|---|---|---|---|
| 5,672,003 | A * | 9/1997 | Shemitz | F21S 2/00 248/214 |
| 7,033,060 | B2 | 4/2006 | Dubuc | |
| 7,674,010 | B2 * | 3/2010 | Griffiths | F21V 11/10 362/240 |
| 7,722,230 | B2 | 5/2010 | Chien | |
| 7,926,985 | B2 | 4/2011 | Teng et al. | |
| 8,104,920 | B2 | 1/2012 | Dubord | |
| 8,109,652 | B2 * | 2/2012 | Chen | F21V 19/0045 362/249.02 |
| 8,313,213 | B2 | 11/2012 | Lin et al. | |
| 2006/0146531 | A1 | 7/2006 | Reo et al. | |
| 2008/0212323 | A1 * | 9/2008 | Chien | H04N 5/2354 362/249.07 |
| 2009/0279298 | A1 * | 11/2009 | Mier-Langner | F21V 21/096 362/235 |
| 2010/0118526 | A1 | 5/2010 | Chien | |
| 2012/0075857 | A1 * | 3/2012 | Verbrugh | F21S 8/038 362/249.01 |

* cited by examiner

Fig 1-1

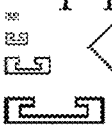

1 track-means for different size mainly for LED linear light. Mini track-means +Mini LED-unit for mini products. same as medium and large and extra-large.

Fig 1-2

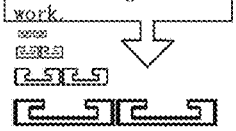

2 track-means side by side will increase LED-units number and double brightness than 1 track-means good for downlight for work.

Fig 1-3

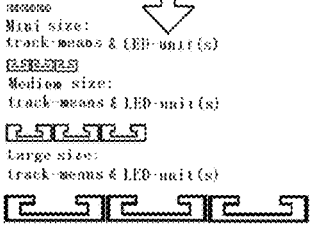

3 track means side by side has more relatively usb units for more brighter output.

Mini size:
track-means & LED-unit(s)

Medium size:
track-means & LED-unit(s)

Large size:
track-means & LED-unit(s)

Extra large size:
track-means & LED-unit(s)

Fig 1-4

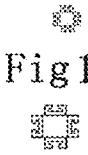

Mini track-means for mini LED-unit(s) to use for LED-Bulb for 360 degree illumination.

Medium track-means for medium size LED-unit(s) to use for portable LED light application.

Large size track-means for bigger size of LED-unit(s) for bed, desk, camping, garden, outdoor, indoor 360 illumination.

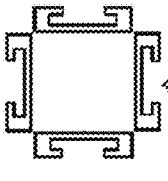

X large track-means has XL LED-unit(s) for floor, Patio, Table, Bed, construction zone, door, garden, play ground, swimming pool, camping, and industrial use for 360 degree lighting.

2 track-means in 90 degree extension good for corner light which only emit light to two-direction not waste to emit two wall. Difference size track-means with different LED-unit

Fig 1-5

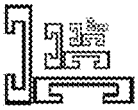

2 overlap track-means can has one level for LED-unit(s) and other level for circuit-means and all other parts & accessories storage space. same as 3 levels.

Fig 1-6

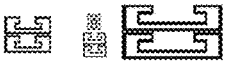

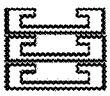

Fig 1-7

Fig 1-8

LED-unit(s) within track-means

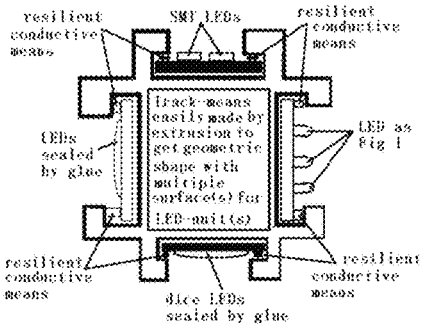

Rectangular

Plurality of individual track-mean(s) to form more than one surface(s) geometric construction each track-mean to others to form desire consturction.

OR/ one track means has more than one surface(s) meet special requirement.

Fig 1-9

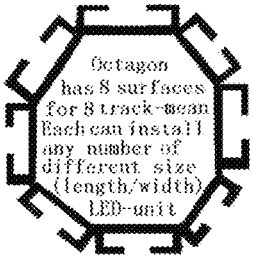

Each LED-unit(s) has any number LED-mean(s) which can select from conventional market any available LED.

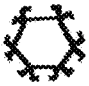

Hexagon
has 6 surface(s)
for 6 track-mean

Fig 1-10

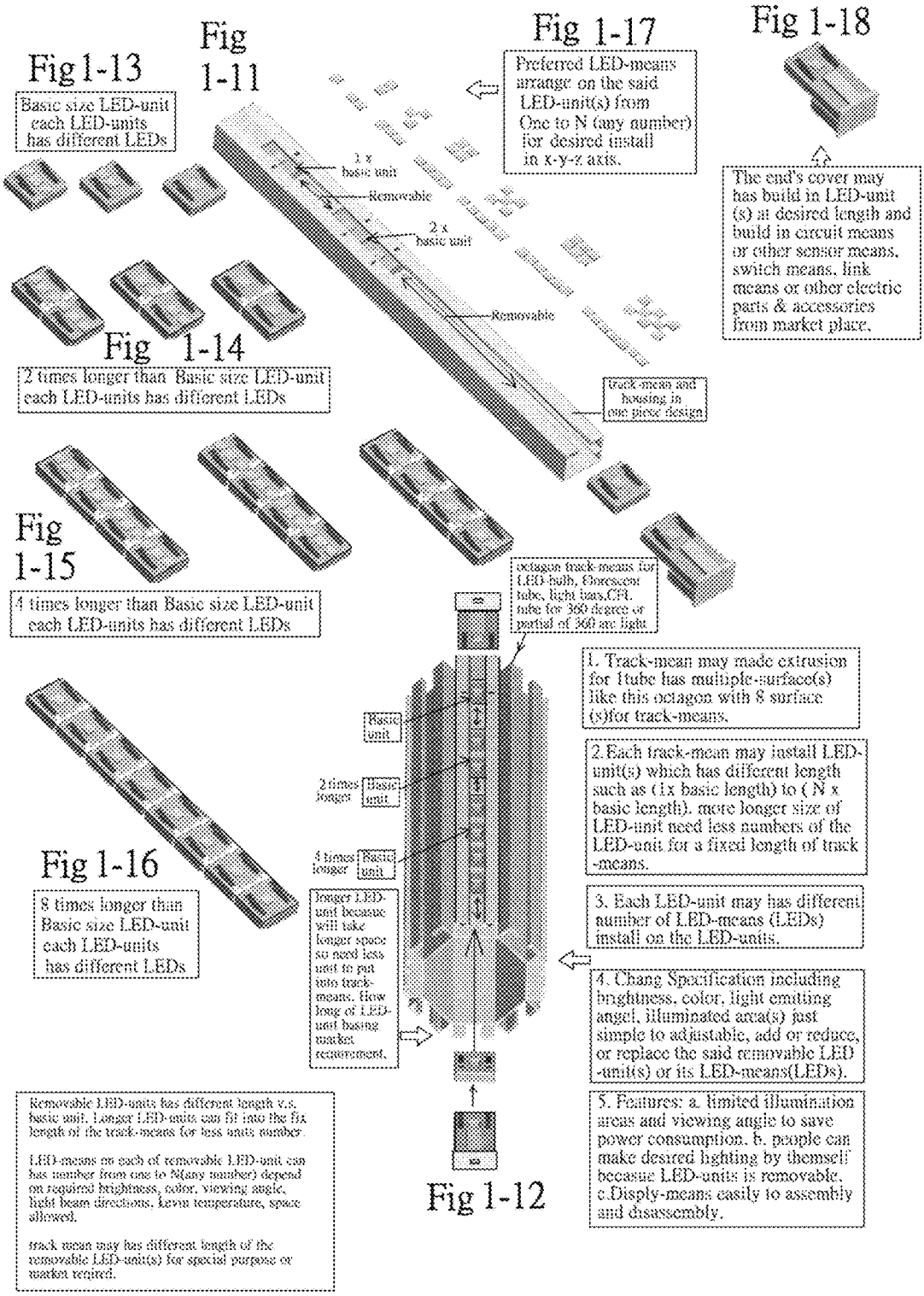
Fig 1-13
Basic size LED-unit each LED-units has different LEDs
Fig 1-11
1 x basic unit
Removable
2 x basic unit
Removable
Fig 1-17
Preferred LED-means arrange on the said LED-unit(s) from One to N (any number) for desired install in x-y-z axis.
Fig 1-18
The end's cover may has build in LED-unit (s) at desired length and build in circuit means or other sensor means, switch means, link means or other electric parts & accessories from market place.
Fig 1-14
2 times longer than Basic size LED-unit each LED-units has different LEDs
track-mean and housing in one piece design
Fig 1-15
4 times longer than Basic size LED-unit each LED-units has different LEDs
octagon track-means for LED-bulb, Gorescent tube, light bars,CFL tube for 360 degree or partial of 360 arc light
1. Track-mean may made extrusion for 1tube has multiple-surface(s) like this octagon with 8 surface (s)for track-means.
Basic unit
2 times longer
Basic unit
4 times longer
Basic unit
2. Each track-mean may install LED-unit(s) which has different length such as (1x basic length) to ( N x basic length). more longer size of LED-unit need less numbers of the LED-unit for a fixed length of track -means.
Fig 1-16
8 times longer than Basic size LED-unit each LED-units has different LEDs
longer LED-unit because will take longer space so need less unit to put into track-means. How long of LED-unit basing market requirement.
3. Each LED-unit may has different number of LED-means (LEDs) install on the LED-units.
4. Chang Specification including brightness, color, light emitting angel, illuminated area(s) just simple to adjustable, add or reduce, or replace the said removable LED -unit(s) or its LED-means(LEDs).
Removable LED-units has different length v.s. basic unit. Longer LED-units can fit into the fix length of the track-means for less units number.
LED-means on each of removable LED-unit can has number from one to N(any number) depend on required brightness, color, viewing angle, light beam directions, kevin temperature, space allowed.
track mean may has different length of the removable LED-unit(s) for special purpose or market required.
Fig 1-12
5. Features: a. limited illumination areas and viewing angle to save power consumption. b. people can make desired lighting by themself because LED-units is removable. c.Disply-means easily to assembly and disassembly.

Co-inventor's prior art and CIP and Division filing for Clip-on LED-assembly along the length of track or add/reduce LEDs from ends.

U.S. Patent May 25, 2010 Sheet 6 ogf 6 US 7,722,230 B2

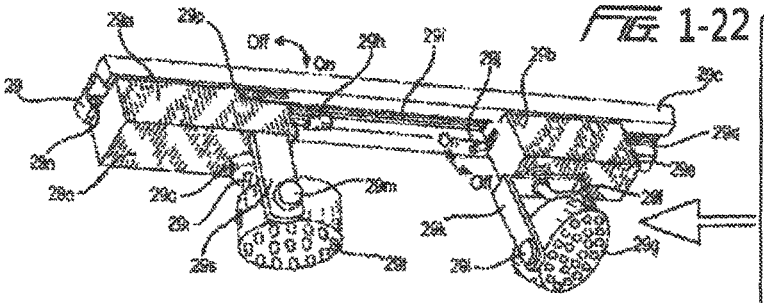

FIG. 1-22

LED-assembly (ies) has removeable conductive mean to clip-on anywhere along the track -means for LED florescent-tube with removable cover/shade/ lens/ lip piece(s)/ protective means to become a finished light- device(s).

clip-on LED-units along track length by clip-on skill.

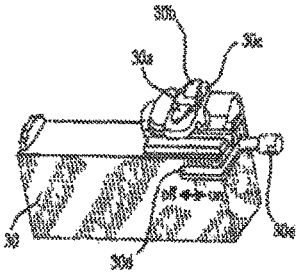

FIG. 1-23

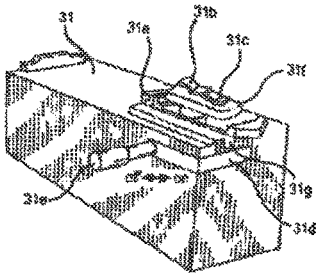

one of example of the said clip-on means

FIG. 1-24

Add-on LED-unit(s) or LED-assembly from ends.

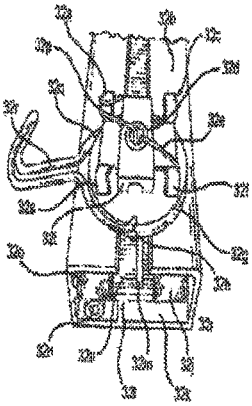

FIG. 1-25

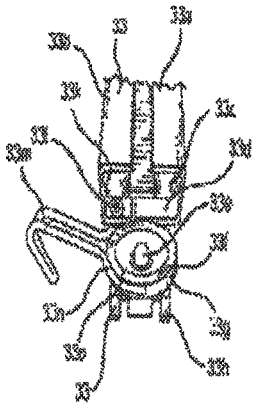

Add-on LED-unit(s) or LED assembly from ends.

FIG. 1-26

Fig 2
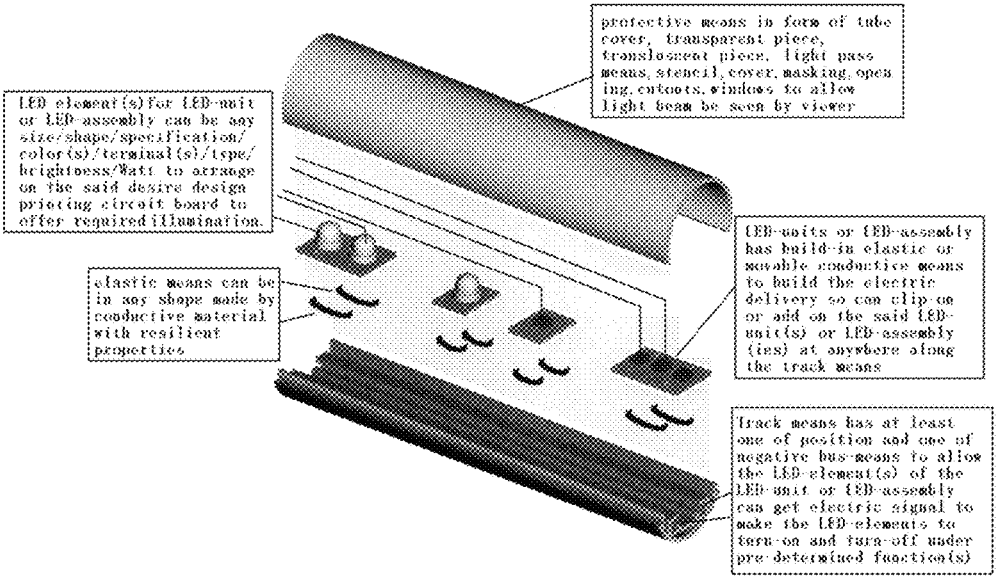
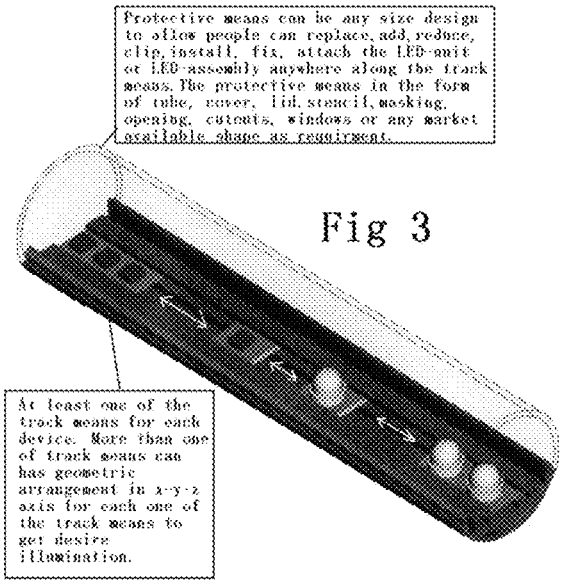
Fig 3

Adjust LED-elements legs and orientation can get the desired light effects !

To make proper arrange for the plurality of individual track-means(s) units into the desire geometric construction relate to each other also can get same light effects.

Relation for LED-Element(s) with Elastic/Resilient conductive means.
Fig 11
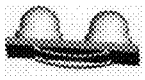
Fig 13
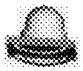
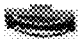
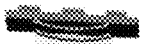
Fig 12
Fig 14
Fig 15
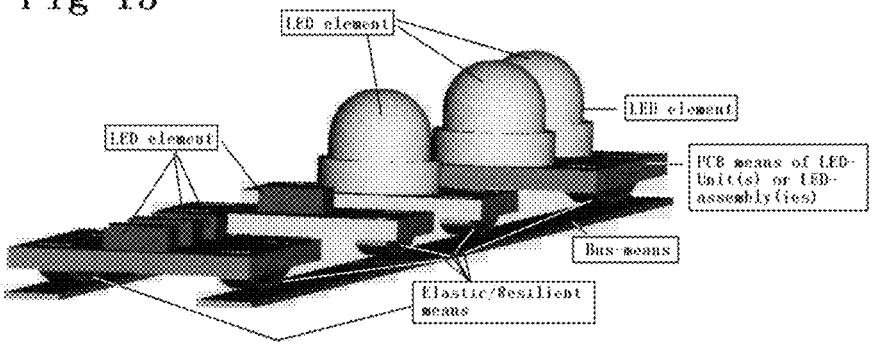
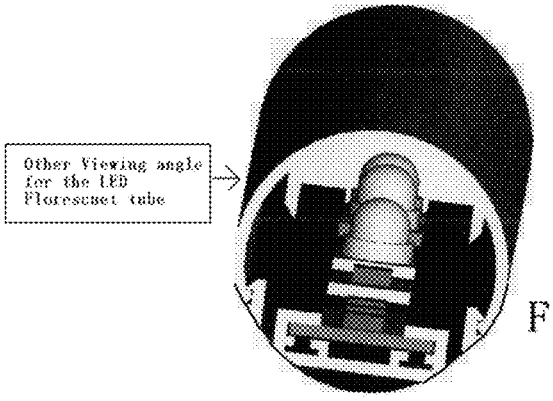
Fig 16

DEVICE HAS LED TRACK MEANS WITH REMOVABLE LED-UNITS WHICH CLIP-ON ANYWHERE ALONG THE LENGTH OR ADD-ON FROM ENDS

This is continuously filing for Ser. No. 13/296,508 "The device has build-in Digital Data means and powered by unlimited power source of the LED Bulb". This is continuously filing for Ser. No. 13/295,301 "The device has build-in Digital Data means and powered by unlimited power source of the Light Device". This is continuously filing for Ser. No. 13/296,469 "The device has build-in Digital Data means and powered by unlimited power source of the Lamp Holder".

The all (#LLL) drawing is use the old drawing as attached PARENT drawing. So, the current invention is CIP filing for (#LLL-2011) 13-367,687 now pay issue fee!! Also, the current invention is CIP filing for below listed filing case for all drawing is same as below listed filed drawing and concept and construction for LED track light.

U.S. Pat. No. 8,950,899 (#HHH-2011)=→13-162,824 filed on Jun. 17, 2011

U.S. Pat. No. 8,944,669 (#NNN)=====→13-367,816 Filed on Feb. 7, 2012

U.S. Pat. No. 8,393,755 (#T-1)=======→12-894,865 Filed on Sep. 30, 2010

U.S. Pat. No. 8,083,392 (#RR-10)==→12-887,709 Filed on Sep. 22, 2010

All these are Continuously filing for Ser. No. 13/296,508, Ser. No. 13/295,301, Ser. No. 13/296,469 are continuously filing for Ser. No. 13/162,824 Light device with display means has track-means and removable LED-unit(s) which are the continuously filing for Ser. No. 12/938,628 LED light fixture has outlet(s) and removable LED unit(s) and for Ser. No. 12/887,700 Light fixture with self-power removable LED unit(s). Those are continuously filing for Ser. No. 12/149,963 (Now U.S. Pat. No. 7,722,230), Ser. No. 12/073,095 (Now U.S. Pat. No. 7,726,869), Ser. No. 12/073,889 (Co-Pending Filing), Ser. No. 12/007,076 (Now U.S. Pat. No. 7,726,841), Ser. No. 12/003,691 (Now U.S. Pat. No. 7,726,839), Ser. No. 12/894,865 (Co-Pending Filing).

BACKGROUND

The current invention design for LED bulb or LED Fluorescent tube or other LED light source which The Device has LED Track means with removable LED-units which clip-on anywhere along the length or add-on from ends.

From market place all the said LED Bulb or LED Fluorescent tube of other LED light source which normally has special design such as Philips or Osram or Feith with their complicated construction in order to get wide view angle of light and high brightness. But each of them has very complicated construction and costly for their design. The current invention incorporated unique removable LED-units along the track means can easily to get the (1) Add or Reduce Removable LED-units anywhere along the length or from ends (2) Only need to make several different numbers of surface track-means can make variety different brightness, size, diameter, length, viewing angle, shape to get full range of existing incandescent bulb or really fluorescent tube or other light source's looking to let consumer replace without any mistake (3) Offer sufficient working illumination as head-width and get the LED illumination as people's shoulder width to save non-working area(s) illumination which means save a lot of power consumption of non-working area(s) LED light cost and energy saving (4) Come out the most economical LED light source to let consumer willing to replace the Incandescent or Really Fluorescent tube to super power saving LED light source to save power consumption, save money, save energy and save earth.

The most important the current invention can make any requirement for brightness, illumination areas, color of light, size of illumination area(s) and can be adjustable the above details by consumer itself in seconds.

It is appreciated the current invention has all above discussed co-pending or issued patent's drawing, details description and content are still been the parent filing of the current invention and all such drawing, detail description, contents should be still fall within the scope of the current invention and not limited to the current drawing, details description, content.

DRAWING

1. FIG. 1-1 to FIG. 1-10 disclosure the different arrangement for track means for One track means to 8 track means for desire arrangement. More than one track means can has desire geometric arrangement in x-y-z axis to make the different light effects while has certain number of LED-unit(s) or LED-assembly(ies) with build-in LED elements.

2. FIGS. 1-11 to 1-18 disclosure the different size and arrangement for the LED-unit(s) or LED-assembly(ies) which has housing means to sealed each of LED-unit(s) or LED-assembly(ies). Also, disclosure the LED-element(s) arrange on each of the said LED-unit(s) or LED-assembly(ies).

3. From FIGS. 1-19 to 1-21 disclosure the LED-unit(s) or LED-assembly(ies) has resilient/elastic conductive means and add, replace, reduce, assembly, dis-assembly into the said one track means or more than one track means which has desire geometric combination in x-y-z axis to make the desire position, relation, orientation of each track means so the build-in LED-element(s) will make certain light function(s), performance(s), light show(s) as pre-determined program.

4. From FIG. 1-22 to FIG. 1-26 disclosure the current invention for the Light source has LED-unit(s) or LED-assembly(ies) with movable conductive means to clip, add, insert, replace, remove, assembly, dis-assembly the said LED-unit(s) or LED-assembly(ies) at anywhere along the track means for current invention. The current invention has protective means to arrange all said LED-unit(s) or LED-assembly(ies) within so can become a finish light source.

5. From FIG. 2 to FIG. 16 disclosure the construction of the current invention for protective means, and LED-unit(s) or LED-assembly(ies), and resilient/elastic conductive means or moveable conductive means, and track-means relations.

6. From FIG. 5A disclosure more than one of track means geometric arrangement in x-y-z axis to get minimum and maximum size to make desired light performance which including 3, 4, 6, 8 track means each track means has different LED-unit(s) or LED-assembly(ies) with build-in different size, number of LEDs LED-elements so can make the different geometric size/shape/tube/bar for light device.

DETAILS DESCRIPTION

The current invention has 22 major features as listed below which offer a-power saving and easy installation of LED-unit(s) having extendable and retractable movable contacts on the back of the LED-unit and which connect with bus-strips. The contacts have magnetic force and conductive properties to deliver electric power to the LED-unit through magnetic-units in the contacts and get current from the bus-strips, which are connected with a power source for the electric current. The LED-unit at least has one pair of magnetic/resilient and conductive contacts (also referred to herein as contactors) to deliver electric power from the bus-strips and connect with an inner circuit of the LED-unit(s). The contactors are non-polarized so can make any connect the pair contactor to any way to magnetic bus-strips. The LED unit(s) having built-in magnetic-properties to make it easier for people to assemble (not shown in the drawing). It also has very limited number of LED-unit(s) installed on the track. In one preferred embodiment, the total space or length occupied by the number of magnetic and conductive LED-unit(s) length may be only ⅕, ¼, ⅓, ½ of the total track length. Also, the total length of LED-unit(s) illumination or lighted area is at least one person's shoulder width so people can move the LED-unit(s) to a right position within the track and light the shoulder-width areas for work. This is very good to only offer limited shoulder-width LED-unit illumination from inside the track to let people save a lot of cost over conventional light devices with fully loaded LED(s) extending over a whole track length. Not only does this save power consumption but it also saves a lot of cost to encourage people to replace non-LED products with the LED products of the current invention having a limited number of LED unit(s) in a partial space of the LED tube.

1. A LED light device, comprising:

at least one track assembly for installing a plurality of different or same of LED-unit anywhere along the length or from end of the track assembly;

the said each of LED-unit including at least one LED(s) as light source, said LED light source having predetermined specification including brightness, color, illumination direction, viewing angle, and illumination area;

The each of LED-unit has resilient or movable conductive contractors for getting electric-power from bus-strip, or-and built-in circuit, or-and circuit built-in or added-on to the track assembly to cause LED light source to turn on and off according to predetermined controller, functions, performance, and duration; and the each of LED-unit being arranged to be installed anywhere along the length or inserted into from the end of the track assembly, the LED-unit having selective features including geometric shape, size, cover, housing, insulation, movable contact by magnetic-force and holding parts that allow people to adding or reduce or move or remove number of LED-unit(s) install or attached on the bus-strip, or change number of LEDs of LED-unit, or change position of each LED-unit. The LED-units can move or remove or add to track assembly, change position, add, remove, assemble, or disassemble from the track assembly; and wherein has protective housing is a housing, or part of housing, cover, lid, shade has light transmitting window(s) or section(s) or area(s) that can open to resembles and replaces LED-unit(s) wherein said protective housing assembled with track-assembly which encloses buss-strip(s) and the plurality of LED-units to form an LED light device.

The improvement;

The track assembly has the said number of bus-strip(s) can delivery electric signal or has magnetic property, and each of bus-strip has number of positive or-and negative electric current to single or-and plurality of single color or multiple color LED light source.

The track assembly and protective housing made by one or more than one piece of plastic or metal material assembled together to form the said light device by screw, catcher, sonic sealing, glue, compound, push tight, fasten items to form a finished light device.

2. A LED light device, wherein the at least one track assembly is assembled by top piece and lower piece or more piece in Z-axis relation and bus-strips fit within between pieces for easily installation the conductive buss-strips.
3. A LED light device, wherein LED-unit is one of a mini-size or compact size of LED application light device including (1) tube-like fluorescent tube, (2) bulb has base, (3) LED light with magnetic to attached on track assembly, or (4) LED light for any construction has base and bendable arms and LED-unit(s) can fit within or attached on track assembly has easily movable function.
4. A LED light device, wherein the resilient conductive contact piece is metal or copper material with round or radius contact-ends so can smoothly move and change position within the track assembly and electrically connect and disconnect with the surface of bus-strip.
5. A LED light device, wherein the movable conductive contact piece has metal or copper electric-delivery material as contact to electric pole and connect with bus-strips has magnetic force it will pop-out and make well connection to get electric power or the said movable contact incorporated with built-in magnetic kit and both way contact piece is install on the back side of LED-unit that can attached on anywhere of track-assembly and get power from bus-strip by magnetic kits so can easily add or move-out and change position on the track assembly and electrically connect and disconnect with the surface of bus-strip.
6. A LED light device, wherein the resilient piece deforms upon installation within the space of track-assembly top and lower surface to provide a secure electrical connection between the LED-unit and the bus-strip both are fit-into the track assembly.
7. A LED light device, wherein the LED light device is a fluorescent tube shape which has limited number of tube-like or rectangular shape or linear-shape movable LED-unit(s) those total in x-axis length accumulated is only up to ⅙ or ¼ or ⅔ or more shorter than the track-assembly length so only can offer limited section/area/length of whole LED device length for illumination, and the LED elements are arranged to illuminate a predetermined area only corresponding and each each section or areas for illumination width is close to a people's shoulder width to minimize a number of LED-unit numbers which also reduce LED(s) number to reduce power consumption and cost than the market LED fluorescent tube like light device has big number of LEDs along the whole length.
8. A LED light device, wherein the LED light device is a fluorescent tube light which has section(s) or area(s) of whole device length having movable LED unit(s) to offer limited location illumination and the locations illumination width in x-axis is close or corresponding to a people's shoulder width to minimize a number of LED-unit(s) or LED light source(s) and reduce electric power consumption than the market LED tube-like light device has big number of LEDs fill along the whole length.
9. A LED light device, wherein LED light device is assembled of track assembly and protective housing which has window or lip or cover can open to make change or adjust or repair the inner LED-unit(s) related parts and accessories.

10. A LED light device, wherein LED light device has protective housing to protect inner bus-strips and LED-unit(s) and prevent from people to touch without open the window, lip, cover which has hinge or other joint-kits to allow can open to make adjustment or replacement.
11. A light device, wherein said plurality of LED-units have different arrangements of one or more of said LED light source selected from differences in type, size, shape, pattern, number, color, electric terminals, number of surfaces, brightness, diameter, service like, and function.
12. A light device, wherein said the LED unit has magnetic kits which is install on the center of back of LED unit so can get interaction for magnetic kit with center raised of metal parts of the track-assembly to hold the LED-unit on position without fall down.
13. A light device, wherein said the said LED light device is power source is from AC power from outlet of housing, residence, building.
14. A light device, wherein said the said LED light device power source is a DC power source from batteries, rechargeable battery, AC-to-DC transformer, energy storage device for solar power, wind power, chemical power, water power.
15. A LED light device, the said the said protective housing at least includes first and second protective members, the first or-and second protective member being integrally combined with or combined to form the track assembly,
16. A light device, the said the said first protective member is secured to the track-assembly by at least one hook-shaped catch, screw, fit tight, ultrasonic, glue,
17. A light device, the said the said wherein said first and second or more protective members together form a tube or bulb shaped protective member enclosing said track assembly and said at least one LED-unit.
18. A light device, comprising:

at least one track assembly has plurality of magnetic bus-strips to adhesive or install at least one LED-unit which has pop-out or fall-down metal contact(s) on back and the LED-unit(s) install or remove from anywhere along length by magnetic interaction force.

at least one LED-unit including at least one LED, said LED having predetermined brightness, color, illumination direction, viewing angle, electric signal receiver, IR/RF receiver for offer illumination to area(s);

the LED-unit including conductive piece which can pop-out or fall-down from back housing openings of LED-unit while metal contactor(s) near the bus-strips magnetic force for electrically delivery from bus-strips to each LED-unit to cause the at least one LED predetermined functions, performance, and duration; and the LED-unit having a geometric shape, size, cover, housing, insulation, opening on back, pop-out or fall-down movable construction, and holding parts that allow a person to move, change position, add, remove, assemble, or disassemble the LED-unit; and the LED-units at least has two contractors.

The light device that can use LED-unit back side pop-out and fall-down function incorporate with magnetic bus-strips anywhere along the track length by magnetic force to install LED-unit(s) anywhere for adding or move-out LED-unit(s).

19. A light device, wherein said pop-out and fall-down metal contactor(s) on the back side of LED-unit to adhesive to the bus-strips has strong magnetic force.
20. A light device, wherein said conductive contacts on the back of LED-unit at least one pair or plurality pairs to make color changing for any combination for Red, Green, Blue and White LED(s).
21. A light device, wherein said the magnetic bus-strip on the track at least one pair or plurality of pairs to make contact with LED-unit(s) which has more than one LED light source within.
22. A light device, the said and pop-out and fall-down contractors has no polarized difference design so any way to make 2 contractors connect to any way will not cause the LED(s) inside LED-unit to cause electric shortage.

The current invention apply the co-inventor's prior art or co-pending filing cases of the removable LED-unit(s) or LED-assembly(ies) with Build-in LED-elements has resilient/elastic or movable conductive means to add, reduce, replace, insert, assembly, dis-assembly the said LED-unit(s) or LED-assembly(ies) at anywhere along the track means to get the most power saving, less cost, adjustable illumination area(s), practically un-expensive LED light source which has similar outlook with existing non-LED light sources including Fluorescent tube, Incandescent bulb, PL lamp, U-lamp or other light source which is not LED related light available from market place.

In order to make simple and clear description for all drawing, so all drawing has brief notes for quickly review has its features.

From FIG. 1-1 to FIG. 1-10 disclosure the different arrangement for track means for One track means to 8 track means for desire arrangement. More than one track means can has desire geometric arrangement in x-y-z axis to make the different light effects while has certain number of LED-unit(s) or LED-assembly (ies) with build-in LED elements.

From FIGS. 1-11 to 1-18 disclosure the different size and arrangement for the LED-unit(s) or LED-assembly(ies) which has housing means to sealed each of LED-unit(s) or LED-assembly(ies). Also, disclosure the LED-element(s) arrange on each of the said LED-unit(s) or LED-assembly(ies).

From FIGS. 1-19 to 1-21 disclosure the LED-unit(s) or LED-assembly(ies) has resilient/elastic conductive means and add, replace, reduce, assembly, dis-assembly into the said one track means or more than one track means which has desire geometric combination in x-y-z axis to make the desire position, relation, orientation of each track means so the build-in LED-element(s) will make certain light function(s), performance(s), light show(s) as pre-determined program.

From FIG. 1-22 to FIG. 1-26 disclosure the current invention for the Light source has LED-unit(s) or LED-assembly(ies) with movable conductive means to clip, add, insert, replace, remove, assembly, dis-assembly the said LED-unit(s) or LED-assembly(ies) at anywhere along the track means for current invention. The current invention has protective means to arrange all said LED-unit(s) or LED-assembly(ies) within so can become a finish light source.

From FIG. 2 to FIG. 16 disclosure the construction of the current invention for protective means, and LED-unit(s) or LED-assembly(ies), and resilient/elastic conductive means or moveable conductive means, and track-means relations.

Figure 5:
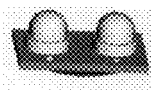
Figure 5A:
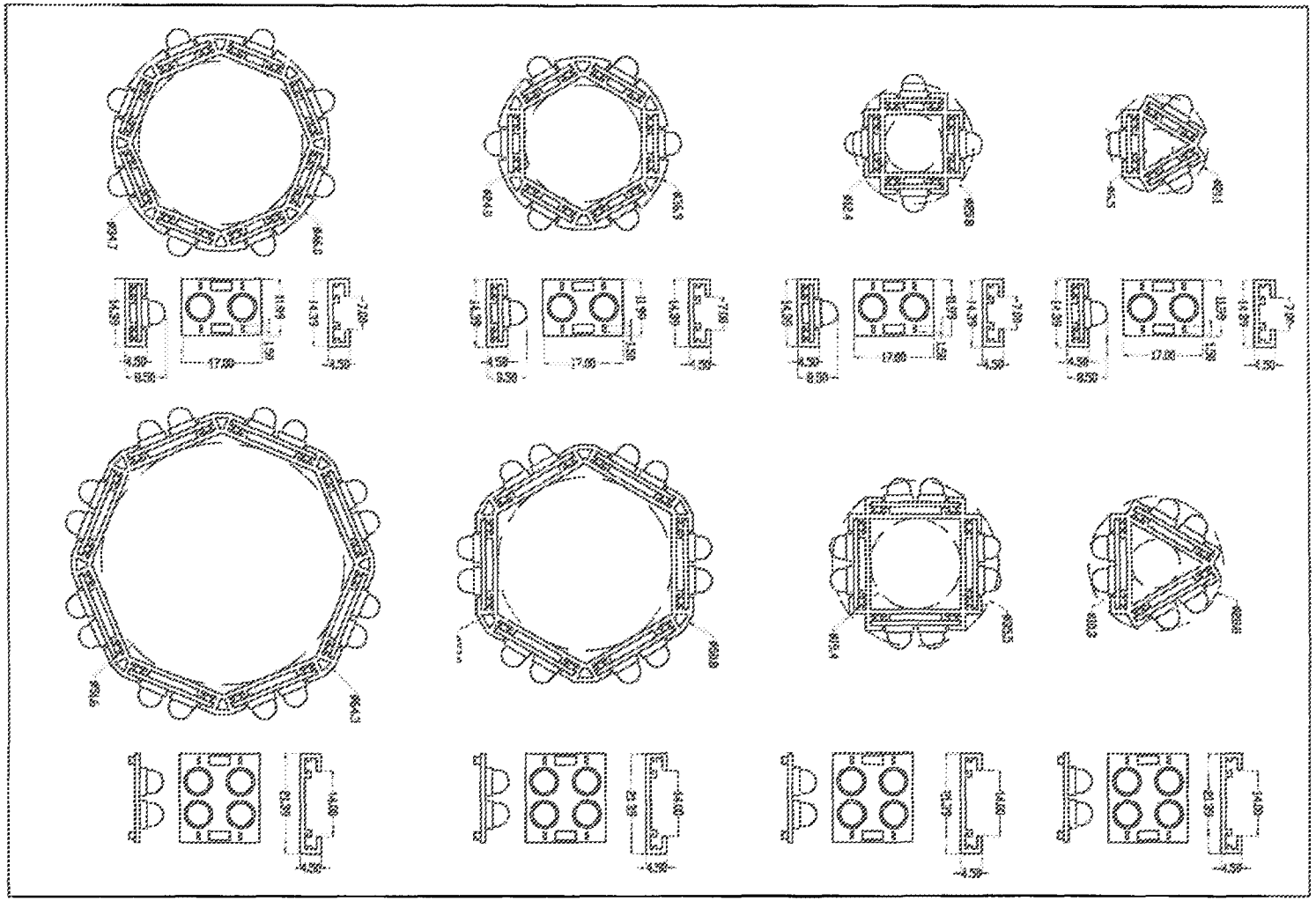
Figure 9:
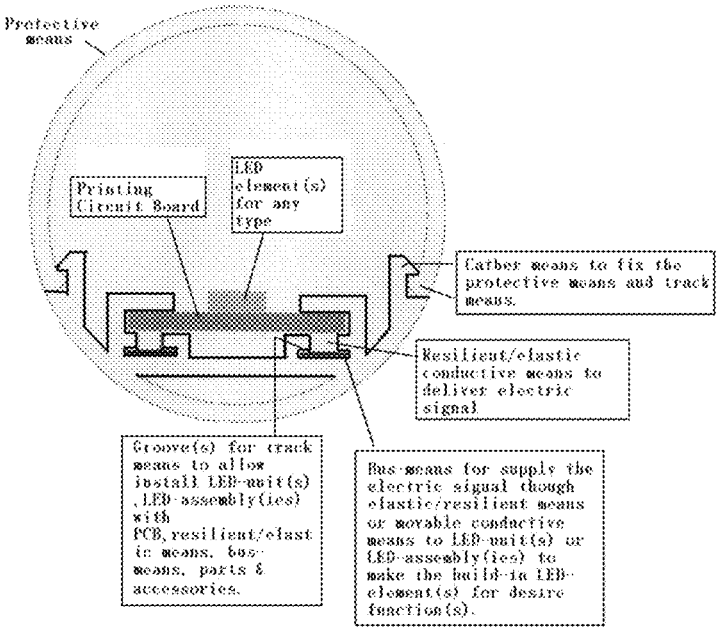
Figure 10:
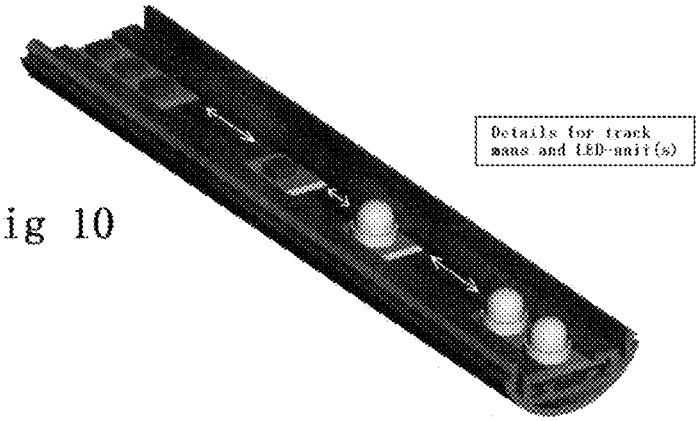

From FIG. 5A disclosure more than one of track means geometric arrangement in x-y-z axis to get minimum and maximum size to make desired light performance which including 3, 4, 6, 8 track means each track means has different LED-unit(s) or LED-assembly(ies) with build-in different size, number of LEDs LED-elements so can make the different geometric size/shape/tube/bar for light.

From these drawing can get the following features of the current invention as below point by points including:

1. The Device has LED Track means with removable LED-units which clip-on anywhere along the length or add-on from ends consist of;

At least one of the Removable LED-unit or LED-assembly has desire number of LED element(s) arrangement to get certain brightness, color, directions, viewing angle(s), illumination area(s), Size of illumination area(s) to offer people to get desired illumination.

At least one of the removable LED-units which without the circuit & parts or LED-assembly which has the circuit & parts can add, replace, reduce from anywhere along the track-means or from the ends.

At least one of the said LED-unit(s) or LED-Assembly(ies) has elastic or movable conductive means to allow the said clip or add on at any position along the said track means and build the electric connection to make the said LED element(s) of the said LED-unit(s) or LED-assembly(ies) to turn-on and turn-off under pre-determined function(s), performance, duration.

The Said LED-unit(s) without the circuit so it will get the LED element(s) trigger electric signal from the track means as input-signal for the LED-unit's LED element(s). the said track-means has at least one positive and one negative electric bus-means to supply the said bus-means' out-put electric signal to said LED elements as input-signal to make said LED-element(s) to get the desire performance, function, light show, duration.

The said LED-assembly(ies) has its own circuit and parts & accessories so LED-assembly(ies)'s LED-element(s) will get the electric signal from its owned circuit and parts & accessories. The LED-assembly(ies)'s track-means has at least one positive and one negative bus-means to supply the LED-assembly(ies)'s circuit for input electric signal and change the input electric signal by its owned circuit to the output-signal to LED-assembly(ies)'s LED elements to make the predetermined function, performance, light show, duration.

The above said LED-unit or LED-assembly can add, reduce, move, assembly, dis-assembly at anywhere along the said track means by the clip-on, twist-on, bend-on, magnetic-on, screw-on, insert-on or other attachment means to install the said LED-unit or LED-assembly on the said track-means to build the electric delivery.

The said LED-unit or LED-assembly or Device has its geometric design, shape, size, cover, housing, isolate body, cover, safety screw, hold-area(s), to allow people can direct or indirectly touch to make the LED-unit(s) or LED-assembly (ies) to move, change position or add, reduce, remove, assembly, dis-assembly, at anywhere along the track means.

The improvement including;

The said Device has its protective-means which may group combination from the said housing, cover, lid, shade, plastic piece, transparent piece, translucent piece, areas, windows, opening(s), cut-out areas to allow people to change position, add, reduce, replace, assembly or dis-assembly, clip, fasten, twist, push, fix the said LED-unit(s) or LED-assembly(ies) from these protective means.

2. The Device has LED Track means with removable LED-units which clip-on anywhere along the length or add-on from ends, the said track-means can made by plastic or metal material.

3. The Device has LED Track means with removable LED-units which clip-on anywhere along the length or add-on from ends, the said device in a form of LED fluorescent tube, LED Bulb, LED PL lamp or other shape of the LED device(s) has the shape, design, outlook similar to conventional traditional non-LED fluorescent tube(s), incandescent bulb(s), PL lamp, Halogen lamp, gas fill lamp.

4. The Device has LED Track means with removable LED-units which clip-on anywhere along the length or add-on from ends, the said movable conductive means can be change conductive means from position A to position B or more position to make the conductive means to build the electric delivery or disconnect the electric delivery.

5. The Device has LED Track means with removable LED-units which clip-on anywhere along the length or add-on from ends, the said elastic conductive means can change the shape while force applied to it but still make the electric delivery by its elastic properties at any time within the track means.

6. The Device has LED Track means with removable LED-units which clip-on anywhere along the length or add-on from ends, the said movable or elastic conductive means made by conductive material in the desired forms including desire combination from piece, plate, spring, strips, wires, conductive printing material which can deliver the electric signal from one place to other place.

7. The Device has LED Track means with removable LED-units which clip-on anywhere along the length or add-on from ends, the said LED-unit(s) or LED-assembly(ies) has LED-elements for people head-width to get the illumination cover people shoulder-width for preferred arrangement to save power and LED-element(s) number and save money.

8. The Device has LED Track means with removable LED-units which clip-on anywhere along the length or add-on from ends, the said track means for desire light function(s), performance(s), light show can has more than one of positive or more than one negative bus-means to connect with multiple electric terminals for light source.

9. The Device has LED Track means with removable LED-units which clip-on anywhere along the length or add-on from ends, the said track means has more than one of the track means for the device and each track means has desire geometric arrangement in x-y-z axis(es) to each of the said track means.

10. The Device has LED Track means with removable LED-units which clip-on anywhere along the length or add-on from ends, The said bus-means is made by conductive material.

11. The Device has LED Track means with removable LED-units which clip-on anywhere along the length or add-on from ends, the said protective means has size, dimension, area(s) to meet market requirement.

12. The Device has LED Track means with removable LED-units which clip-on anywhere along the length or add-on from ends, the said LED-element(s) can be any specification from market available type, size, number of colors, number of electric terminals, brightness, diameter, life, functions.

It is appreciated all the above discussed or refer to or described of the co-inventor's Prior arts, co-pending filing, notes on drawing, alternative parts & accessories, equivalent functional parts & accessories are still fall within the scope of the current invention. It is appreciated the current invention has all above discussed co-pending or issued patent's drawing, details description and content are still been the parent filing of the current invention and all such drawing, detail description, contents should be still fall within the scope of the current invention and not limited to the current drawing, details description, content.

I claim:

1. An LED light device comprising:

a plurality of LED units, each including at least one LED; and at least one track assembly for installing the plurality of LED units anywhere along a length of the assembly; and a track assembly housing containing the at least one track assembly and installed LED units, wherein:

each LED unit has resilient or magnetic conductive contacts for electrically connecting the LED unit to respective bus strips, a built-in circuit, or a circuit built-in or added onto the track assembly to cause the at least one LED to turn on and off according to provide predetermined lighting functions and duration; and each LED unit is adapted to allow people to add, move, or remove at least one LED unit on or within the track-assembly, the track assembly housing is made of at least one piece of plastic or metal material assembled together to form the light device by screws, catches, sonic sealing, glue, an interference fit, or fasteners.

2. An LED light device as claimed in claim 1, wherein the track assembly is assembled from, at least, a top piece and a lower piece in Z-axis relation, and wherein the bus-strips fit between the top and lower pieces.

3. An LED light device as claimed in claim 1, wherein the LED light device is one of a mini-size or compact size LED light device configured as one of: (a) an LED light with a shape of a fluorescent tube, (b) an LED bulb having base, (c) an LED light with magnetic elements to attach the LED units to the track assembly, and (d) an LED light having a base and bendable arms.

4. An LED light device as claimed in claim 1, wherein the resilient or magnetic conductive contacts are made of a metal material with contact-ends configured to smoothly move and change position within or on the track assembly and electrically connect and disconnect with the bus strips.

5. An LED light device as claimed in claim 1, wherein the conductive contacts are extendable from a respective said LED unit, include built-in magnetic elements, and are installed on a back side of the respective LED unit so as to enable the LED unit to be attached anywhere on the track assembly and get power from the bus strips.

6. An LED light device as claimed in claim 1, wherein the conductive contacts are resilient pieces that deform upon insertion into a space between upper and lower surfaces of the track assembly to provide a secure electrical connection between a respective said LED unit and the bus strips, which are both fitted into the track assembly.

7. An LED light device as claimed in claim 1, wherein the LED light device has a tube shape which has a number of tube-like, rectangular, linear, movable said LED units that occupy only a portion of the track assembly length.

8. An LED light device as claimed in claim 7, wherein the LED light device is a tube light having movable said LED units along only a section of a length of the tube light to offer limited location illumination that is close or corresponds to a person's shoulder width to reduce electric power consumption relative to an LED tube-like light device having a large number of LEDs along an entire length of the tube-like light.

9. An LED light device as claimed in claim 1, wherein the track assembly housing has a window, lip or cover configured to provide access to the track assembly to change, adjust or repair the track assembly, bus strips or LED units.

10. An LED light device as claimed in claim 9, wherein the track assembly housing is a protective housing that protects the bus strips and LED units, and wherein the window, lip or cover is hinged to allow said access for change, adjustment, or repair of the track assembly, bus strips or LED units.

11. An LED light device as claimed in claim 1, wherein said plurality of LED units have LED light sources with differences selected from type, size, shape, pattern, number, color, electric terminals, number of surfaces, brightness, diameter, service like, and function.

12. An LED light device as claimed in claim 1, wherein the LED units have magnetic kits installed on two sides away from a center of a back of the respective LED units.

13. An LED light device as claimed in claim 1, wherein a power source of the LED light device is an AC power outlet.

14. An LED light device as claimed in claim 1, wherein a power source of the LED light device is a DC power source selected from at least one battery, a rechargeable battery, an AC-to-DC transformer, and an energy storage device for solar power, wind power, chemical power, or water power.

15. An LED light device as claimed in claim 1, wherein the track assembly housing at least includes first and second protective member integrally combined with, or combined to form, the track assembly.

16. A light device as claim in claim 15, the first protective member is secured to the track assembly by at least one of a hook-shaped catch, screw, interference fit, ultrasonic weld, or glue.

17. An LED light device as claimed in claim 15, the first and second protective members together form a tube or bulb shaped protective member enclosing said track assembly and said LED units.

18. A light device, comprising:

at least one track assembly having a plurality of conductive bus strips and at least one LED unit having at least two extendable and retractable magnetic and conductive contacts for contacting the conductive bus strips, and which can be installed on, moved, or removed from anywhere on a top of the track assembly, wherein the at least one LED unit includes at least one LED, said at least one LED having a predetermined brightness, color, illumination direction, viewing angle, electric signal receiver, and IR/RF receiver for providing area illumination, and wherein the at least two extendable and retractable magnetic and conductive contacts removably hold the at least one LED unit on the conductive strips by magnetic interaction force and conduct power from the bus strips to the at least one LED unit to provide power to the at least one LED.

19. An LED light device as claimed in claim 18, wherein said magnetic and conductive contacts are extendable from and retractable into a back side of a housing of the LED unit to enable installation of the LED unit on any location of the bus strips by said magnetic interaction force.

20. An LED light device as claimed in claim 18, wherein said magnetic and conductive contacts are on the two sides of a back of the at least one LED unit.

21. An LED light device as claimed in claim 18, comprising at least one pair of the LED units to provide color changing for any combination of red, green, blue and white LEDs.

22. An LED light device as claimed in claim 18, extendable and retractable magnetic and conductive contacts are non-polarized to enable the at least one LED unit to positioned in any orientation.

* * * * *